US005268349A

United States Patent [19]

Ohno et al.

[11] Patent Number: 5,268,349

[45] Date of Patent: Dec. 7, 1993

[54] RECORDING MATERIAL

[75] Inventors: Akihiko Ohno; Takatoshi Nishizawa; Akira Iwai, all of Ibaraki, Japan

[73] Assignee: Oji Yuka Goseishi Co., Ltd., Tokyo, Japan

[21] Appl. No.: 969,564

[22] Filed: Oct. 30, 1992

[30] Foreign Application Priority Data

Nov. 1, 1991 [JP] Japan ..... 3-313444

[51] Int. Cl.[5] ..... B41M 5/035; B41M 5/38

[52] U.S. Cl. ..... 503/227; 428/195; 428/212; 428/913; 428/914; 503/200; 503/226

[58] Field of Search ..... 428/195, 212, 913, 914; 503/200, 226, 227

[56] References Cited

U.S. PATENT DOCUMENTS 4,663,216 5/1987 Toyoda et al. ..... 428/212

FOREIGN PATENT DOCUMENTS

0234563A3 9/1987 European Pat. Off. ..... 503/227
0434073A1 6/1991 European Pat. Off. ..... 503/227
0439049A1 7/1991 European Pat. Off. ..... 503/227

*Primary Examiner*—Bruce H. Hess
*Attorney, Agent, or Firm*—Sughrue, Mion, Zinn, Macpeak & Seas

[57] ABSTRACT

A recording material comprising a thermosensitive recording layer (B) or a thermal dye transfer type image receiving layer (B') laminated on a surface layer (b) of a support (A), wherein the support (A) comprises the surface layer (b) comprising a uniaxially stretched thermoplastic resin film laminated onto a base layer (a), wherein the base layer (a) comprises a biaxially stretched film of a thermoplastic resin containing 10 to 45% by weight of an inorganic fine powder, and wherein said support (A) satisfies conditions (1) to (3):

(1) the surface layer (b) of the support (A) comprises at least two layers: an outer layer ($b^1$) comprising a uniaxially stretched film of a thermoplastic resin containing 0 to 30% by weight of an inorganic fine powder; and an inner layer ($b^2$) comprising a uniaxially stretched film of a thermoplastic resin containing 30 to 80% by weight of an inorganic fine powder, wherein the thickness of the outer layer ($b^1$) is 3 to 40% of that of the surface layer (b) and the thickness of the inner layer ($b^2$) is 97 to 60% of that of the surface layer (b);

(2) the thickness of the surface layer (b) is 0.5 to 30% of the whole thickness of the support (A); and (3) the support (A) has a density of not higher than 0.80 g/cm$^3$, an opacity of at least 70%, an compression ratio of 15 to 35% under a stress of 32 kg/cm$^2$ and a surface Bekk smoothness of 500 to 8,000 seconds.

5 Claims, 2 Drawing Sheets

RECORDING MATERIAL

FIELD OF THE INVENTION

The present invention relates to a thermosensitive recording sheet or a thermal dye transfer type image receiving sheet. More particularly, the present invention relates to a recording material which is excellent in resolving power and enables clear recording with high density. The present invention also relates to a recording material which has excellent pencil writeability for adding writing after printing with a die head.

BACKGROUND OF THE INVENTION

A thermosensitive recording process is a recording process wherein a thermosensitive recording head (hereinafter referred to simply as a head) is heated in accordance with input signals to cause a fusion contact between a color former and a color developer on an image receiving sheet (thermosensitive recording paper) in contact with the head, whereby color images can be obtained. The thermosensitive recording process has a recording speed corresponding to the quantity of information capable of being transmitted through a telephone circuit. This process is a primary color formation system which requires neither development nor fixing, and causes very little wear of the head. Because of these advantages, the process has been rapidly spreading to applications to information processing equipment such as printers, facsimile machines, etc.

With rapid development of various types of office devices and the variety of their uses, there is a demand for a thermosensitive recording sheet capable of meeting each particular requirement. For example, as a thermosensitive recording sheet capable of coping with the speed up of the recording device, a demand has arisen to develop a thermosensitive recording sheet capable of providing a clear image with high density even when using only a small amount of printing energy.

It has been recognized that not only thermosensitive recording layers but also supports must be examined to meet the above demand, and the use of synthetic resin films as the support in place of conventional natural paper has been increased.

For example, JP-A-2-70479 (the term "JP-A" as used herein means an "unexamined published Japanese patent application") (U.S. Pat. No. 4,996,182) discloses a thermosensitive recording sheet wherein a biaxially stretched resin film layer having fine voids and a fine void content of 40 to 100 cc/100 g is used as a constituent element of the support for the thermosensitive recording layer, and a thermosensitive recording sheet wherein said biaxially stretched resin film layer is laminated with a film layer comprising the same material as that of the film or a different material from that of the film.

These thermosensitive recording sheets wherein the biaxially stretched film meeting the demand of only voids is used as a constituent element of the support can provide clear images with high density. However, since the surface strength thereof is low, there is a disadvantage that when the sheet is supercalendered to smooth the surface thereof after coating a thermosensitive layer, the coated thermosensitive layer is peeled off.

JP-A-59-148693, JP-A-61-279589, JP-A-62-282970, JP-A-63-99984 and JP-A-63-299976 disclose thermosensitive recording papers using a resin film containing an inorganic fine powder. These thermosensitive recording papers have good surface strength, but none of them can provide a clear image with high density.

Improvements in the high-speed printing of the thermosensitive recording devices have been made in a short time in recent years, and thermal dye transfer type image recording sheets capable of multiple transfer as described in JP-A-63-222891 have also needed to be able to make gradation recording of tone density even at a narrow pulse width.

A thermal dye transfer type image recording process is carried out with a transfer material (ink ribbon) comprising a support having thereon a coloring material layer containing a sublimable or vaporizable dye, which is heated to sublime or vaporize the dye contained in the coloring material layer, and the dye is deposited on an image receiving recording sheet, whereby a dye image can be formed.

As shown in FIG. 1, a transfer material 1 comprising a base 4 having thereon a coloring material layer 5 and an image receiving sheet 2 comprising a support 7 having thereon an image receiving layer 6 are put between a drum 8 and a heat surface 3, and the coloring material layer 5 is heated by means of a head surface capable of being controlled by electric signals, such as a thermal head. A dye contained in the coloring material layer 5 is sublimed or vaporized and deposited on the image receiving layer 6, whereby the thermal dye transfer type image recording can be effected.

The material of the image receiving layer 6 varies depending on the types of coloring materials to be deposited thereon. For example, when the coloring material is a hot-melt type, the support 7 itself may be used as the image receiving layer. When the coloring material is a sublimable disperse dye type, a high-molecular material coat layer such as a polyester coat layer can be used as the image receiving layer.

The support 7 of a conventional image receiving sheet 2 has an uneven thickness and an uneven surface, and hence the surface of the image receiving layer 6 itself has a roughness of 5 to 15 μm and waviness of 10 to 20 μm per mm. This roughness or waviness can be somewhat improved by supercalendering the surface of the image receiving layer 6. However, there is a limit to the degree of the improvement. For example, the surface of a conventional image receiving layer still has a roughness of at least 3 to 5 μm or waviness of at least 10 μm per mm. Accordingly, the coloring material (the hot-melt type as well as the sublimable dye) to be transferred from the coloring material layer 5 can not be correctly transferred according to image signals, and a disorder in image quality, such as unclearness of dots or failure in dots is caused. Further, intermediate tone suffers from roughness.

The supports used include paper, opaque synthetic paper comprising a stretched film of a propylene resin containing inorganic fine powder (as described in JP-B-46-40794 (the term "JP-B" as used herein means an "examined Japanese patent publication") and U.S. Pat. No. 4,318,950) and coated synthetic paper obtained by coating the surface of a transparent polyethylene terephthalate film or a transparent polyolefin film with an inorganic compound such as silica or calcium carbonate together with a binder to increase whiteness and dyeability.

However, when considering the condition (e.g., duplicability, pencil writeability, preservability) of the image receiving sheets after thermal dye transfer type image recording, synthetic paper obtained by stretching a polyolefin resin film containing inorganic fine powder to thereby form many microvoids therein and is preferred from the viewpoints of strength, dimensional stability and close contact with a printing head (see, JP-A-60 245593, JP-A-61-112693 and JP-A-63-193836).

In such synthetic paper obtained by stretching a polyolefin resin film, microvoids are formed in the interior of the film by stretching the film at a temperature of lower than the melting point of the polyolefin resin to impact opacity and soft feeling and to improve contact with a printing head, feedability and dischargeability.

However, improvements in high-speed printing of thermosensitive recording devices have been made in a short time in recent years, and thermal dye transfer type image recording sheets capable of multiple transfer as described in JP-A-63-222891 have also required that a gradation recording of tone density can be made even at a narrow pulse width.

Although the content of the inorganic fine powder can be reduced to increase the surface smoothness of synthetic paper because printing density is increased with an increase in smoothness, the volume of voids in the film is reduced by stretching. As a result, the cushioning effect of synthetic paper is reduced. Accordingly, the density of an image on the thermal dye transfer type image receiving sheet using this synthetic paper as the support is lowered as demonstrated in Comparative Example 1 of JP-A-63-222891.

SUMMARY OF THE INVENTION

The present inventors have made studies to solve the above-described problems and found that when a support formed by laminating a uniaxially stretched thin layer film having improved smoothness and cushioning properties as a surface layer onto the surface of a biaxially stretched porous film base having cushioning properties is used, (1) a thermosensitive recording paper formed by providing a thermosensitive recording layer on the support has excellent resolving power, provides a clear image with high density even using low printing energy, does not cause curling by heat even after printing, and is excellent in after-use such as preservability and pencil writeability and pencil writeability after printing, and (2) a thermal dye transfer type recording paper formed by providing an image receiving layer on the support has excellent resolving power, provides a clear transfer image with high density even using low printing energy and is excellent in after-use such as preservability and pencil writeability after printing.

The present invention has been accomplished on the basis of these findings.

Accordingly, the present invention provides a recording paper comprising a thermosensitive recording layer (B) or a thermal dye transfer type image receiving layer (B') laminated on a surface layer (b) of a support (A), wherein the support (A) comprises the surface layer (b) comprising a uniaxially stretched thermoplastic resin film laminated onto the surface of a base layer (a), wherein the base layer (a) comprises a biaxially stretched film of a thermoplastic resin containing 10 to 45% by weight of an inorganic fine powder, and wherein the support (A) satisfies the following conditions (1) to (3):

(1) the surface layer (b) of the support (A) comprises at least two layers: an outer layer ($b^1$) comprising a uniaxially stretched film of a thermoplastic resin containing 0 to 30% by weight of an inorganic fine powder; and an inner layer ($b^2$) comprising a uniaxially stretched film of a thermoplastic resin containing 30 to 80% by weight of an inorganic fine powder, the thickness of the outer layer ($b^1$) is 3 to 40% of that of the surface layer (b), and the thickness of the inner layer ($b^2$) is 97 to 60% of that of the surface layer (b);

(2) the thickness of the surface layer (b) is 0.5 to 30% of the whole thickness of the support (A); and (3) the support (A) has a density of not higher than 0.80 g/cm$^3$, an opacity of at least 70%, a compression ratio of 15 to 35% under a stress of 32 kg/cm$^2$ and a Bekk smoothness of 500 to 8,000 seconds.

DETAILED DESCRIPTION OF THE INVENTION

Now, the present invention will be illustrated in more detail below.

I THERMOSENSITIVE RECORDING PAPER

(1) Structure

Figure 1:
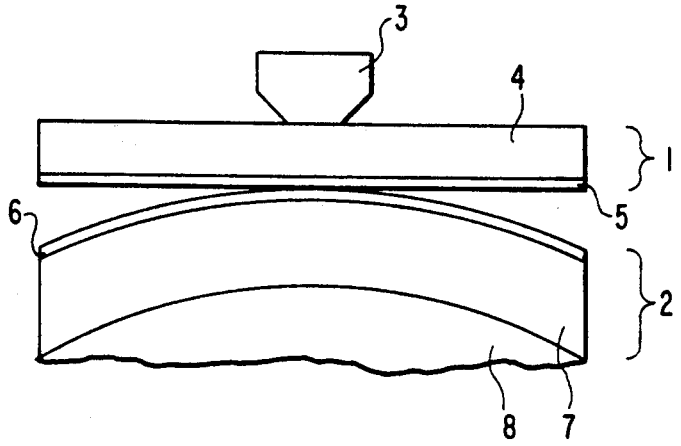
FIG. 1 is a plain view showing printing on a thermal dye transfer type image receiving paper through a transfer material (ink ribbon).
Figure 2:
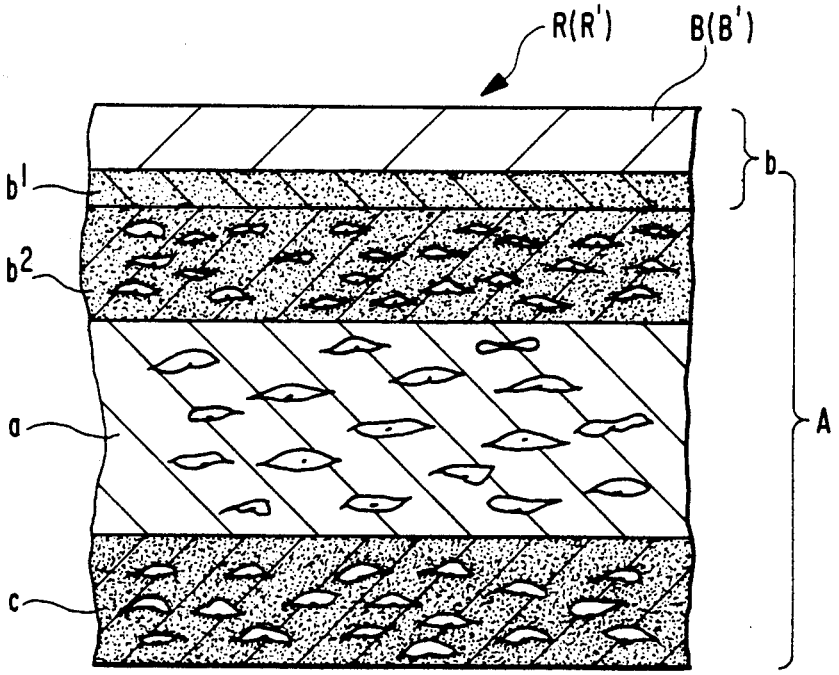
FIG. 2 is a sectional view illustrating an embodiment of a thermosensitive recording paper or a thermal dye transfer type image receiving paper according to the present invention.

FIG. 2 is a sectional view illustrating an embodiment of a thermosensitive recording paper according to the present invention. Referring to FIG. 2, the thermosensitive recording paper (R) of the present invention comprises basically a thermosensitive recording layer (B) provided on the surface layer (b) of a support (A) formed by laminating a surface layer (b) comprises at least two layers: an outer layer ($b^1$) comprising a uniaxially stretched film of a thermosensitive resin containing 0 to 30% by weight of an inorganic fine powder; and an inner layer ($b^2$) comprising a uniaxially stretched film of a thermoplastic resin containing 30 to 80% by weight of an inorganic fine powder onto the surface of a base (a) comprising a biaxially stretched film of a thermoplastic resin containing 10 to 45% by weight of an inorganic powder and optionally providing a back layer (c) on the back side thereof.

(2) Support for Thermosensitive Recording

The support (A) for the thermosensitive recording paper of the present invention has a surface layer (b) composed of a uniaxially stretched thermoplastic resin film laminate laminated onto the surface of the base (a) comprising a biaxially stretched film of a thermoplastic rein containing 10 to 45% by weight, preferably 15 to 35% by weight of an inorganic fine powder, and it is essential that the physical properties of the support meet the following conditions (1) to (3).

(1) The surface layer (b) comprises a uniaxially stretched film laminated consisting of at least two layers of an outer layer ($b^1$) comprising a uniaxially stretched film of a thermoplastic resin containing 0 to 30% by weight, preferably 5 to 25% by weight of an inorganic fine powder and an inner layer ($b^2$) comprising a uniaxially stretching film of a thermoplastic resin containing 30 to 80% by weight, preferably 40 to 65% by weight of an inorganic fine powder; and the thickness of the outer layer ($b^1$) is 3 to 40%, preferably 5 to 35% of that of the surface layer (b) and the thickness of the inner layer ($b^2$) is 97 to 60%, preferably 95 to 65% of that of the surface layer (b).

(2) The thickness of the surface layer (b) is 0.5 to 30%, preferably 3 to 25% of the overall thickness of the support (A).

(3) The support (A) has a density of not higher than 0.80 g/cm$^3$, preferably 0.55 to 0.77 g/cm$^3$, an opacity of at least 70%, preferably 80 to 100% as measured according to JIS-P 8138, a compression ratio (a compressed rate when a load of 32 kg/cm$^2$ is applied) of 15 to 35%, preferably 20 to 35%, and a Bekk smoothness of 500 to 8,000 seconds, preferably 700 to 7,000 seconds as measured according to JIS-P 8119.

In an embodiment of the support (A), a uniaxially stretch film of a polyolefin containing 10 to 45% by weight of an inorganic powder is used as the base layer (a). The surface layer (b) which comprises at least two layers of an outer layer ($b^1$) comprising an unstretched polyolefin film or an unstretched film of a polyolefin resin composition containing not more than 30% by weight of an inorganic fine powder and an inner layer ($b^2$) comprising an unstretched film of a thermoplastic resin containing 30 to 80% by weight of an inorganic fine powder is laminated onto the base layer (a) so that the thickness of the outer layer ($b^1$) is 3 to 40% of that of the surface layer (b), and the thickness of the inner layer ($b^2$) is 97 to 60% of that of the surface layer (b). The support (A), composed of the film laminate, is stretched in the direction perpendicular to the stretching direction of the uniaxially stretched polyolefin film of the base layer (a) by means of at tenter to form a biaxially stretched film from the uniaxially stretched film of the base layer (a) and to uniaxially stretch the resin film laminate composed of the outer layer ($b^1$) and the inner layer ($b^2$). In this manner, a support (A) can be obtained, wherein the thickness of the surface layer (b) is 0.5 to 30% of the overall thickness the support (A), which is composed of a multi-layer structural thermoplastic resin film and has physical properties such that the density is not higher than 0.80 g/cm$^3$, the opacity is at least 70%, the compression ratio is 15 to 35% and the Bekk smoothness is 500 to 8,000 seconds.

When the amount of inorganic fine powder contained in the base layer (a) of the support (A) is less than the amount defined above, opacity is lowered, and the contrast of the image becomes poor. When the amount of inorganic fine powder is more than the amount defined above, the strength of the thermosensitive recording paper is lowered. When the total thickness of the outer layer ($b^1$) and the inner layer ($b^2$) of the surface layer (b) exceeds 30% of the whole thickness of the support (A), the density of the whole support is increased, and the developed color density is lowered.

When the amount of inorganic fine powder contained in the outer layer ($b^1$) of the surface layer (b) exceeds 30% by weight, Bekk smoothness is lowered, and the developed color density is lowered. In addition, the surface strength is reduced, and the adhesion of the coat is poor. Thus, such an amount is not preferred. On the other hand, when the amount of inorganic fine powder contained in the outer layer ($b^1$) is not more than 30% by weight, Bekk smoothness is improved even when the thickness of the layer exceeds 40% of the surface layer (b). However, when the thickness of the layer exceeds 40% of the surface layer (b), the void content is lowered as a whole, compressibility is lowered, the developed color density is lowered, and further, pencil writeability is lowered.

When the amount of inorganic fine powder contained in the inner layer ($b^2$) of the surface layer (b) is less than the amount defined above, the cushioning effect can not be obtained, the opacity is lowered, and the contrast of the image becomes poor. When the amount is more than the amount defined above, the cushioning effect is lost, and the color density is lowered.

When the thickness of the surface layer (b) based on the whole thickness of the support (A) is less than the above-described lower limit, the cushioning effect is lost, and the contrast of the resulting image becomes poor. When the thickness of the surface layer (b) exceeds the above upper limit, the strength of thermosensitive recording paper is lowered.

When the opacity is less than the above lower limit, the contrast of the image becomes poor, and the image is difficultly perceptible.

The higher the Bekk smoothness, the higher the developed color density and high-speed printing can be achieved. However, when Bekk smoothness is too high, sticking is caused, and there is a possibility that the developed color density is lowered. The higher the opacity of the support, the higher the contrast of the image, and the image is more perceptible.

There is a correlation between the density of the support (A) and the compression ratio thereof. As the number of microvoids increases, the density decreases, but the compression ratio becomes higher. As the density (defined by JIS-P 8118) of the support (A) decreases or as the compression ratio increases, the contact between the thermosensitive recording paper and the head improves, and the color density becomes higher. However, when the compression ratio is too high, the density becomes too low, and the support loses its bending strength. On the other hand, when the compression ratio is too low, the cushioning effect is lost and the color density is lowered.

Usually, the surface layer (b) comprises a uniaxially stretched thermoplastic film laminate composed of two layers of the outer layer ($b^1$) comprising a uniaxially stretched film of a thermoplastic resin containing 0 to 30% by weight of an inorganic power and the inner layer ($b^2$) comprising a uniaxially stretched film of a thermoplastic resin containing 30 to 80% by weight of an inorganic fine powder. If desired, other stretched film as an interlayer ($b^3$) may be interposed between both layers.

Further, the support (A) for the thermosensitive recording paper of the present invention may be optionally provided with a backing layer comprising pulp paper or polyethylene terephthalate or a paper-like layer or a back layer (c) comprising a uniaxially stretched film of polypropylene containing an inorganic fine powder on the back side of the support as a layer other than the base layer (a) and the surface layer (b) comprising the outer layer ($b^1$) and the inner layer ($b^2$).

The back layer (c), comprising a uniaxially stretched film of a thermoplastic resin, is provided on the back side of the support (A) to improve feedability and dischargeability. The back layer (c) contains 0 to 80% by weight, preferably 10 to 65% by weight of an inorganic fine powder to improve pencil writeability. The thickness of the back layer (c) is 0.5 to 30%, preferably 3 to 25% of the whole thickness of the support (A). A thermosensitive recording paper provided with the back layer (c) is excellent in anti-curling properties.

Further, the same layer as the surface layer (b) may be provided on the back side of the base layer (a) of the support (A) for thermosensitive recording.

(3) Thermosensitive Recording Layer

The thermosensitive recording layer (B) provided on the support (A) can be formed by coating a coating composition containing a color former and a color developer on the support and drying it.

Although there is no particular limitation with regard to the coating weight of the coating composition, coating weight thereof is usually 2 to 12 g/m$^2$, preferably 3 to 10 g/m$^2$, on a dry basis.

Any of the combinations of the color former and the color developer to be contained in the thermosensitive recording layer can be used, so long as a color reaction takes place when they are brought into contact with each other.

II PRODUCTION OF THERMOSENSITIVE RECORDING PAPER (1) Constituent Material (a) Thermoplastic Resin Polyolefins are usually used as the thermoplastic resin in the base layer (a), the surface layer (b) and the back layer (c) of the support (A).

Examples of the polyolefins include polyethylene, polypropylene, ethylene-propylene copolymer, ethylene-vinyl acetate copolymer, propylene-butene-1 copolymer, poly(4-methylpentene-1) and polystyrene. Other thermoplastic resins such as polyamide, polyethylene terephthalate and polybutylene phthalate can also be used. However, polypropylene-based resins are preferred to reduce costs.

(b) Inorganic Fine Powder

Examples of the inorganic fine powder which can be used in the base layer (a), the surface layer (b) and the back layer (c) of the support (A) include powders having an average particle size of not larger than 10 μm such as powders of calcium carbonate, calcined clay, diatomaceous earth, talc, titanium oxide, barium sulfate, aluminum sulfate and silica. Powder having an average particle size of not larger than 4 μm are particularly preferred.

(c) Color Former and Color Developer

The thermosensitive recording layer (B) can be formed by coating a coating composition containing a color former and a color developer and drying it.

Examples of the color former and the color developer which can be used in the thermosensitive recording layer (B) include those described below. Any of the combinations of these color formers and these color developers can be used, so long as a color reaction takes place when they are brought into contact with each other. Examples of the combinations which can be used in the present invention include the combinations of colorless or light color basic dyes and inorganic or organic acid materials, the combination of metal salts of higher fatty acids such as iron (III) stearate and phenols such as gallic acid and the combination of diazonium compounds, couplers and basic materials.

Color Formers

Various known compounds can be used as the colorless or light color basic dyes used as the color formers in the thermosensitive recording layer.

Examples of the compounds which can be used as the color formers in the present invention include triallylmethane dyes such as 3,3-bis(p-dimethylaminophenyl)-6-dimethylaminophthalide, 3,3-bis(p-dimethylaminophenyl)phthalide, 3-(p-dimethylaminophenyl)-3-(1,2-dimethylindol-3-yl)phthalide, 3-(p-dimethylaminophenyl)-3-(2-methylindol-3-yl)phthalide, 3,3-bis(1,2-dimethylindol-3-yl)-5-dimethylaminophthalide, 3,3-bis(1,2-dimethylindol-3-yl)-6-dimethylaminophthalide, 3,3-bis(9-ethylcarbazol-3-yl)-6-dimethylaminophthalide, 3,3-bis(2-phenylindol-3-yl)-6-dimethylaminophthaide, 3-p-dimethylaminophenyl-3-(1-methylpyrrol-3-yl)-6-dimethylaminophthalide, etc.; diphenylmethane dyes such as 4,4'-bis-dimethylaminobenzhydryl benzyl ether, N-halophenylleucoauramine, N-2,4,5-trichlorophenyl-leucoauramine, etc.; thiazine dyes such as benzoyl leucomethylene blue, p-nitrobenzoyl leuco-methylene blue, etc.; spiro dyes such as 3-methyl-spiro-dinaphthopyran, 3-ethylspiro-dinaphthopyran, 3-phenyl-spiro-dinaphthopyran, 3-benzyl-spiro-dinaphthopyran, 3-methyl-naphtho(6'-methoxybenzo)-spiropyran, 3-propyl-spiro-dibenzopyran, etc.; lactam dyes such as Rhodamine-B anilinolactam, Rhodamine(p-nitroanilino)lactam, Rhodamine(o-chloroanilino)lactam, etc.; and fluoran dyes such as 3-di-methylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3-diethylamino-6,7-dimethylfluoran, 3-(N-ethyl-p-toluidino)-7-methylfluoran, 3-diethylamino-7-N-acetyl-N-methylaminofluoran, 3-diethylamino-7-N-methylaminofluoran, 3-diethylamino-7-dibenzylaminofluoran, 3-diethylamino-7-N-methyl-N-benzylaminofluoran, 3-diethylamino-7-N-chloroethyl-N-methylaminofluoran, 3-diethylamino-7-N-diethylaminofluoran, 3-(N-ethyl-p-toluidino)-6-methyl-7-phenylaminofluoran, 3-(N-cyclopentyl-N-ethylamino)-6-methyl-7-anilinofluoran, 3-(N-ethyl-p-toluidino)-6-methyl-7-(p-toluidino)fluoran, 3-diethylamino-6-methyl-7-phenylaminofluoran, 3-diethylamino-7-(2-carbomethoxyphenylamino)fluoran, 3-(N-ethyl-N-isoamylamino)-6-methyl-7-phenylaminofluoran, 3-(N-cyclohexyl-N-methylamino)-6-methyl-7-phenylaminofluoran, 3-piperidino-6-methyl-7-phenylaminofluoran, 3-piperidino-6-methyl-7-p-butylphenylaminofluoran, 3-diethylamino-6-methyl-7-xylidinofluoran, 3-diethylamino-7-(o-chlorophenylamino)fluoran, 3-dibutylamino-7-(o-chlorophenylamino)fluoran, 3-pyrrolidino-6-methyl-7-p-butylphenylaminofluoran, 3-N-methyl-N-tetrahydrofurfurylamino-6-methyl-7-anilinofluoran, 3-N-ethyl-N-tetrahydrofurfurylamino-6-methyl-7-anilinofluoran, etc.

Developers

Various compounds are known for use as the inorganic or organic acid materials that are brought into contact with the basic dyes to form a color.

Examples of the inorganic acid materials include activated clay, terra abla, attapulgite, bentonite colloidal silica, and aluminum silicated.

Examples of the organic acid materials include phenolic compounds such as 4-tert-butylphenol, 4-hydroxydiphenoxide, α-naphthol, β-naphthol, 4-hydroxyacetophenol, 4-tert-octylcatechol, 2,2'-dihydroxydiphenol, 2,2'-methylene-bis(4-methyl-6-tert-isobutylphenol), 4,4'-isopropylidene-bis(2-tert-butylphenol), 4,4'-sec-butylidenediphenol, 4-phenylphenol, 4,4'-isopropylidenediphenol (bisphenol A), 2,2'-methylenebis(4-chlorophenol), hydroquinone, 4,4'-cyclohexylidenediphenol, benzyl 4-hydroxybenzoate, dimethyl 4-hydroxyphthalate, hydroquinone monobenzyl ether, novolak phenol resins, phenol polymers, etc.; aromatic carboxylic acids such as benzoic acid, p-tert-butylbenzoic acid, trichlorobenzoic acid, terephthalic acid, 3-sec-butyl-4-hydroxybenzoic acid, 3-cyclohexyl-4-hydroxybenzoic acid, 3,5-dimethyl-4-hydroxybenzoic acid, salicylic acid, 3-isopropyl-salicyclic acid, 3-tert-butylsalicyclic acid, 3-benzylsalicylic acid, 3-(α-methylbenzyl)salicylic acid, 3-chloro-5-(α-methylbenzyl)salicylic acid, 3,5-di-tert-butylsalicylic acid, 3-phenyl-5-(α,α-dimethylbenzyl)salicylic acid, 3,5-di-α-methylbenzylsalicyclic acid, etc.; and the salts of the foregoing phenolic compounds or aromatic carboxylic acids with polyvalent metals such as zinc, magnesium, aluminum, calcium, titanium, manganese, tin, nickel, etc.

Weight Ratio

The basic dyes (color formers) and the developers may be used either alone or in combination of two or more of them. The ratio of the basic dyes to the developers used varies depending on the types of basic dyes and developers used. However, the basic dyes and the developers are generally used in an amount of 1 to 20 parts by weight, preferably 2 to 10 parts by weight of the developer per one part by weight of the basic dye.

Coating Composition

The coating composition containing these materials is generally prepared by uniformly or separately dispersing the basic dye (color former) and the developer in water, as a dispersion medium, by stirring and grinding using means such as a ball mill, an attritor, a sand mill, etc.

The coating composition generally contains a binder such as a starch, hydroxyethyl cellulose, methyl cellulose, carboxymethyl cellulose, gelatin, casein, gum arabic, polyvinyl alcohol, acetoacetyl group-modified polyvinyl alcohol, a diisobutylene/maleic anhydride copolymer salt, a styrene/maleic anhydride copolymer salt, an ethylene/acrylic acid copolymer salt, a styrene/butadiene copolymer emulsion, a urea resin, a melamin resin, an amide resin, an amino resin, etc., in an amount of from about 2 to 40% by weight, and preferably from about 5 to 25% by weight of the total solid components.

Other Compound Additives

The coating composition may contain various additives. Examples of the additives include dispersants such as sodium dioctyl sulfosuccinate, sodium dodecylbenzenesulfonate, sodium salt of lauryl alcohol sulfuric ester and metal salts of fatty acids; ultraviolet light absorbers such as benzophenone ultraviolet absorbers; anti-foaming agents, fluorescent dyes, colored dyes and electrically conductive materials.

Further, the coating composition may optionally contain waxes such as zinc stearate, calcium stearate, polyethylene wax, carnauba wax, paraffin wax, ester wax, etc.; fatty acid amides such as stearic acid amide, stearic acid methylenebisamide, oleic acid amide, palmitic acid amide, coconut fatty acid amide, etc.; hindered phenols such as 2,2'-methylenebis(4-methyl-6-tert-butylphenol), 1,1,3-tris(2-methyl-4-hydroxy-5-tert-butylphenyl)butane, etc.; ultraviolet absorbent such as 2-(2'-hydroxy-5'-methylphenyl)benzotriazole, 2-hydroxy-4-benzyloxybenzophenone, etc.; esters such as 1,2-di(3-methylphenoxy)ethane, 1,2-dipenoxyethane, 1-phenoxy-2-(4-methylphenoxy)ethane, terephthalic acid dimethyl ester, terephthalic acid dibutyl ester, terephthalic acid dibenzyl ester, p-benzyl-biphenyl, 1,4-dimethoxynaphthalene, 1,4-diethoxynaphthalene, 1-hydroxynaphthoic acid phenyl ester, etc.; various kinds of known thermoplastic substances, and inorganic pigments such as kaoline, clay, talc, calcium carbonate, calcined clay, titanium oxide, diatomaceous earth, fine granular anhydrous silica, active clay, etc.

(2) Production of the Support

(a) Thermoplastic Resin Containing Inorganic Fine Powder

Usually, a thermoplastic resin is blended with the aforesaid inorganic fine powder and the resulting blend is melt-kneaded in the production of the base layer (a) or the surface layer (b) comprising the outer layer ($b^1$) and the inner layer ($b^2$) which constitute the support (A) for the thermosensitive recording paper of the present invention.

A resin composition obtained by blending the aforesaid thermoplastic resin with 10 to 45% by weight of an inorganic fine powder is used in the production of the base layer (a). A resin composition obtained by blending a thermoplastic resin with 0 to 30% by weight of an inorganic fine powder is used in the production of the outer layer ($b^1$). A resin composition obtained by blending a thermoplastic resin with 30 to 80% by weight of an inorganic fine powder is used in the production of the inner layer ($b^2$).

(b) Production of Laminated Film

In the production of the support, the polyolefin film of the base layer (a) is stretched usually 3 to 7 times, preferably 4 to 6 times in the longitudinal direction by utilizing the difference in peripheral speed between rollers. A resin film laminate composed of the outer layer ($b^1$) and the inner layer ($b^2$) is laminated onto the stretched film of the base layer (a), and the resulting laminate is stretched 4 to 12 times, preferably 5 to 10 times in the width direction using a tenter.

In this manner, a support (A) which is a multi-layer structural thermoplastic resin film and has a density not higher than 0.80 g/cm$^3$, preferably 0.55 to 0.77 g/cm$^3$, an opacity of at least 70%, preferably at least 80%, a compression ratio of 15 to 35%, preferably 20 to 35% and a Bekk smoothness of 500 to 8,000 seconds, preferably 700 to 7,000 seconds, can be obtained.

The thickness of the support is 60 to 1,000 μm, preferably 60 to 200 μm. The thickness of the surface layer (b) is 0.5 to 30%, preferably 3 to 25% of the whole thickness of the support (A). The thickness of the outer layer ($b^1$) is 3 to 40%, preferably 5 to 35% of that of the surface layer (b), and the thickness of the inner layer ($b^2$) is 97 to 60%, preferably 95 to 65% of that of the surface layer (b).

(3) Production of Thermosensitive Recording Paper

Thermosensitive recording paper can be formed by providing the thermosensitive recording layer (B) containing the color former and the color developer on the surface of the surface layer (b) of the support (A) for thermosensitive recording.

(a) Coating and Drying

The thermosensitive recording layer (B) of the thermosensitive recording paper of the present invention can be formed by coating the coating composition using air knife coating, blade coating, etc., followed by drying without particular limitation.

The coating weight of the coating composition is usually 2 to 12 g/m$^2$, preferably 3 to 10 g/m$^2$ on a dry basis, though there is no particular limitation with regard to the coating weight of the coating composition.

An overcoat layer may be provided on the thermosensitive recording layer (B) of the thermosensitive recording paper to protect the thermosensitive recording layer (B). In addition, various known techniques in the field of producing thermosensitive recording paper, such as application of an adhesive treatment to the back side of thermosensitive recording paper to convert the thermosensitive recording paper into an adhesive label, etc. may be optionally used, if desired.

III THERMAL DYE TRANSFER TYPE IMAGE RECEIVING SHEET

The thermal dye transfer type image receiving sheet (R') of the present invention can be formed by providing a thermal dye transfer type image receiving layer (B') on the surface of the support (A) in place of the thermosensitive recording layer (B) in the thermosensitive recording paper (R) as shown in FIG. 2.

The thermal dye transfer type image receiving layer (B') is illustrated below.

(1) Material

Acrylic resins and polyolefin-based high-molecular materials are suitable materials onto which hot-melt type coloring materials including pigments are well transferable.

Preferred resins which are dyeable with sublimable or vaporizable dyes include high-molecular materials such as polyesters and materials such as activated clay.

Among them, acrylic resins are preferred. More specifically, acrylic resins include (A) acrylic copolymer resins;

(B) mixtures of the following ingredients (1) or (3):

(1) acrylic copolymer resins, (2) amino compounds having amino group, and (3) epoxy compounds; and (C) mixtures of the above component (A) or (B) and inorganic or organic fillers.

Examples of monomers which can be used in the production of the acrylic copolymer resins of the above (A) include dimethylaminoethyl methacrylate, diethylaminoethyl methacrylate, dibutylaminoethyl methacrylate, dimethylaminoethyl acrylamide, diethylaminoethyl methacrylamide and dimethylaminoethyl methacrylamide.

Examples of vinyl monomers which can be used together with the above-described monomers in the production of the acrylic copolymer resins include styrene, methyl methacrylate, ethyl acrylate, n-butyl acrylate, t-butyl acrylate, ethyl methacrylate, vinyl chloride, ethylene, acrylic acid, methacrylic acid, itaconic acid, acrylonitrile and methacrylamide.

Examples of the amino compounds of the above ingredient (2) include polyethylenepolyamines such as diethylenetriamine and triethylenetetramine, polyethyleneimine, ethylene urea, epichlorohydrin adducts of polyaminepolyamides (e.g., Kymene-557H manufactured by Dick-Hercules; AF-100 manufactured by Arakawa Rinsan Kagaku Kogyo KK) and aromatic glycidyl ether or ester adducts of polyaminepolyamides (e.g., Sanmide 352, Sanmide 351 and X-2300-75 manufactured by Sanwa Kagaku KK; Epicure 3255 manufactured by Shell Kagaku KK).

Examples of the epoxy compounds of the above ingredient (3) include bisphenol A glycidyl ether, bisphenol F diglycidyl ether, diglycidyl phthalate, polypropylene glycol diglycidyl ester and trimethylol propane triglycidyl ether.

Examples of the inorganic fillers which can be used as the above component (C) include synthetic silica such as white carbon and inorganic pigments such as calcium carbonate, clay, talc, aluminum sulfate, titanium dioxide and zinc oxide. The fillers have an average particle size of not larger than 0.5 μm. Preferred are synthetic silica such as white carbon and inorganic pigments such as precipitated calcium carbonate. The average particle size is preferably not larger than 0.2 μm.

Organic fillers which can be used as the above component (C) include particles of various high-molecular materials. The particle size thereof is preferably not larger than 10 μm. Specific examples of the high-molecular materials which can be used as the organic fillers include methyl cellulose, ethyl cellulose, polystyrene, polyurethane, urea, formalin resin, melamine resin, phenolic resin, iso(or diiso)butylene/maleic anhydride copolymer, styrene/maleic anhydride copolymer, polyvinyl acetate, polyvinyl chloride, vinyl chloride/vinyl acetate copolymer, polyester, polyacrylic ester, polymethacrylic ester and styrene/butadiene/acrylic copolymer.

These fillers are used in an amount of usually not more than 30% by weight.

It is preferred that the surfaces of the inorganic fillers are treated with nonionic, cationic or amphoteric surfactants such as Turkey red oil, sodium dodecylsulfate, organic amines, metallic soap and sodium ligninsulfonate, whereby the wettability of the thermal dye transfer type image receiving sheet with ink can be improved.

(2) Coating

The thermal dye transfer type image receiving layer (B') is coated on the outermost surface layer side of the support and dried. The coating can be carried out by using conventional coaters such as a blade coater, an air knife coater, a roll coater and a bar coater or a size press, a gate roll machine, etc.

The thermal dye transfer type image receiving layer has a thickness of generally 0.2 to 20 μm, preferably 0.5 to 10 μm.

(3) Other Treatment

If desired, the thermal dye transfer type image receiving sheet can be subjected to calendering to further improve surface smoothness.

An overcoat layer may be provided on the thermal dye transfer type image receiving layer to protect the layer. Further, various known techniques in the field of producing the thermal dye transfer type image recording sheet, such as an application of an adhesive treatment to the back surface of the thermal dye transfer type image recording sheet to convert it into an adhesive label, etc. may be optionally employed.

(4) Use

The thus-obtained thermal dye transfer type image receiving sheet can be used in a thermal dye transfer type recording process, which is useful for recording monochromatic images or full color images with continuous gradation through a thermal head, and recording mediums thereof. More specifically, the sheet can be used in video printers and thermal facsimiles.

The present invention is further illustrated by means of the following examples and comparative examples.

In the following examples and comparative examples, physical properties are determined in the following manner.

(1) Evaluation Method

Compression Ratio

Compression ratio is the compressed rate of a specimen when a load of 32 kg/cm$^2$ is applied, and the compression ratio is determined from the following formula.

$$\text{Compression Ratio } (\%) = (t_0 - t_1)/t_0 \times 100$$

wherein $t_0$ is thickness ($\mu$m) of a specimen, and $t_1$ is thickness ($\mu$m) of a specimen when compressed under a load of 32 kg/cm$^2$.

Evaluation on the Adhesion of Coating

After the coating of the coating composition for forming the thermosensitive recording layer or the thermal dye transfer type image receiving layer, an adhesive tape (Cello-Tape manufactured by Nichiban Co., Ltd.) is firmly stuck on the printing surface and quickly peeled off along the coated surface, and the degree of peeling-off of the coating from the surface is visually observed. Evaluation is made using the following five grades.

Figure 3:
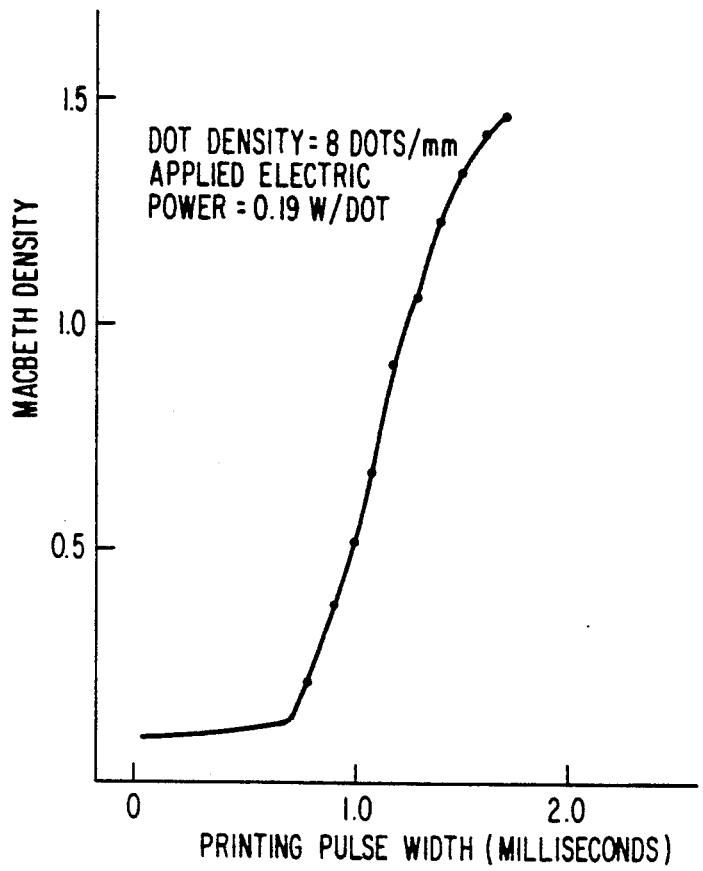
FIG. 3 is a graph showing the relationship between the pulse width of a recording head and the Macbeth density of an image printed on the thermosensitive recording paper.

5: Very good
4: Good
3: No problem in practical use
2: Problem in practical use
1: Bad Printing Performance of Thermosensitive Recording Paper Macbeth Density Printing is made on the surface of the thermosensitive recording paper using a printer (dot density=8 dots/mm, applied electric power=0.19 W/dot, manufactured by Okura Denki KK) while changing the printing pulse width to thereby determine Macbeth density. The relationship between the printing pulse width and the Macbeth density is then determined (see, FIG. 3).

The Macbeth density (low density region) at a pulse width of 0.8 milliseconds is shown in Table 2 and Table 4.

Gradation

The gradation of the print obtained is visually evaluated using the following five grades.

Figure 4:
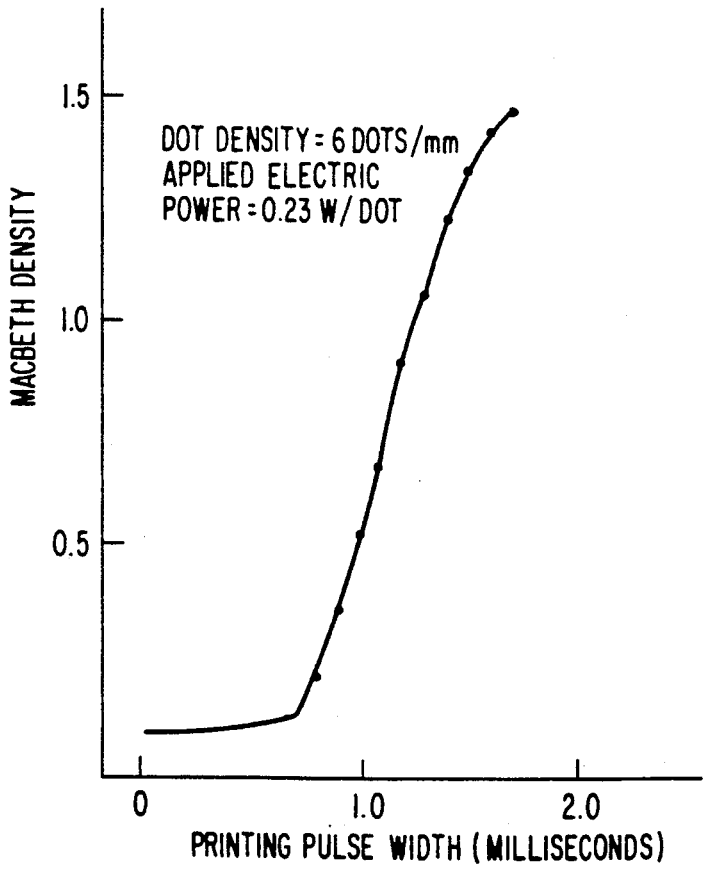
FIG. 4 is a graph showing the relationship between the pulse width of a recording head and the Macbeth density of an image printed on the thermal dye transfer type image receiving paper.

5: Very good
4: Good
3: No problem in practical use
2: Problem in practical use
1: Bad Printing Performance of Thermal Dye Transfer Type Image Receiving Sheet Printing is made on the surface of the thermal dye transfer type image receiving sheet by using a printer (dot density: 6 dots/mm, applied electric power: 0.23 W/dot, manufactured by Okura Denki KK while changing the printing pulse width to examine Macbeth density (see, FIG. 4).

The gradation of the print obtained at a pulse width of 1.3 milliseconds is visually evaluated, using the following five grades.

5: Very good
4: Good
3: No problem in practical use
2: Problem in practical use
1: Bad Pencil Writeability Measurement is made using a writeability tester manufactured by Toyo Seiki KK.

After printing, the thermosensitive recording paper or the thermal dye transfer type image receiving sheet is placed on a table, and a line is drawn on the space of the printed surface (surface side) thereof and on the back side thereof by sliding the lead of a mechanical pencil (3H, the diameter of the lead: 0.3 mm) 10 cm while applying a load of 142 g to the lead. The density of the line is measured with gray scale photographic step table No. 2 manufactured by Kodak. Criterion is made in the following manner.

Good writeability: at least 15
Practically usable: 12 to 14
Not practicable: 11 or below (2) Experiment

EXAMPLE 1

Production of Support (A) for Thermosensitive Recording (1) A blend obtained by blending 15% by weight of calcium carbonate having an average particle size of 1.5 $\mu$m with 80% by weight of polypropylene having a melt flow rate (MFR) of 0.8 g/10 min and 5% by weight of high-density polyethylene was kneaded in an extruder set to a temperature of 270° C. and extruded into a sheet. The sheet was cooled by using a cooling device to obtain an unstretched sheet. The sheet was heated to 150° C. and then stretched 5 times in the longitudinal direction to obtain a 5 times-stretched sheet for the base layer (a).

(2) A resin composition for the outer layer ($b^1$) composed of a mixture of 85% by weight of polypropylene having an MFR of 4.0 g/10 min and 15% by weight of calcium carbonate having an average particle size of 1.5 $\mu$m and a resin composition for the inner layer ($b^2$) composed of a mixture of 55% by weight of polypropylene having an MFR of 4.0 g/10 min and 45% by weight of calcium carbonate having an average particle size of 1.5 $\mu$m were separately melt-kneaded in extruders at 230° C. The die orifice was adjusted to obtain a film laminate wherein the final thickness of the outer layer ($b^1$) after stretching was 3 $\mu$m and the thickness of the inner layer ($b^2$) after stretching was 12 $\mu$m, and the melt-kneaded compositions were co-extruded into a film laminate.

The extruded film laminate for the surface layer (b) was laminated onto one side of the 5 times-stretched sheet for the base layer (a). Separately, a resin composition for the back layer (c), composed of a mixture of 55% by weight of polypropylene having an MFR of 4.0 g/10 min and 45% by weight of calcium carbonate having an average particle size of 1.5 μm was melt-kneaded in other extruder. The die orifice was adjusted so that the final thickness of the back layer (c) after stretching was 15 μm, and the melt-kneaded composition was extrusion-laminated onto the other side of the stretched sheet for the base layer (a).

Subsequently, the resulting laminate was cooled to 60° C., reheated to 165° C. and stretched 7.5 times in the width direction by means of a tenter, followed by annealing at 165° C. The laminate was cooled to 60° C. and trimmed to obtain a support (A) for thermosensitive recording, which was composed of a stretched resin sheet laminate having a four layer structure ($b^1/b^2/a/c=3$ μm/12 μm/50 μm/15 μm) and a thickness of 80 μm.

The structure and composition of the support (A) for thermosensitive recording, composed of a stretched resin sheet laminate are shown in Table 1. The support (A) had a density of 0.72 g/cm$^3$, an opacity of 91%, a compression ratio of 27% and a Bekk smoothness of 1,200 seconds, as shown in Table 2.

Production of Coating Composition for Thermosensitive Recording Layer

The coating composition for the thermosensitive recording layer, which is coated on the support, was produced in the following manner.

| (1) Production of composition A | |
|---|---|
| 3-(N-Ethyl-N-isoamylamino)-6-methyl-7-phenylaminofluoran | 10 parts |
| Dibenzyl terephthalate | 20 parts |
| Methyl cellulose (5% aqueous solution) | 20 parts |
| Water | 40 parts |

The composition was crushed in a sand mill into particles having an average particle size of 3 μm.

| (2) Production of composition B | |
|---|---|
| 4,4'-Isopropylidenediphenol | 30 parts |
| Methyl cellulose (5% aqueous solution) | 40 parts |
| Water | 20 parts |

The composition was crushed in a sand mill into particles having an average particle size of 3 μm.

(3) Production of Coating Composition 90 parts of the composition A, 90 parts of the composition B, 30 parts of silicon oxide pigment (Mizukasil P-527, average particle size: 1.8 μm, oil absorption: 180 cc/100 g, manufactured by Mizusawa Kagaku KK), 300 parts of a 10% aqueous solution of polyvinyl alcohol and 28 parts of water were mixed and stirred to obtain a coating composition.

Production of Thermosensitive Recording Paper

The outer layer ($b^1$), positioned at the outermost surface of the support (A) for thermosensitive recording composed of the stretched resin sheet laminate, was coated with an aqueous coating solution containing a polyethylene anchoring agent and silica for preventing blocking to provide an anchor coat. Subsequently, the above-prepared coating composition for the thermosensitive recording layer was coated thereon to provide a coating weight of 5 g/m$^2$ on a dry basis. The coated support was dried and supercalendered to obtain a thermosensitive recording paper.

The resulting thermosensitive recording paper was evaluated. The results are shown in Table 2.

EXAMPLES 2 TO 5 AND 8 TO 10, COMPARATIVE EXAMPLES 1 TO 7

The procedure of Example 1 was repeated except for changing the composition of each layer of the support (A) for thermosensitive recording and the value of the die orifice as shown in Tables 1 and 3. Supports (A), having the physical properties shown in Tables 2 and 4, were obtained.

In the same manner as in Example 1, the thermosensitive recording layer (B) was formed on the support (A).

The resulting thermosensitive recording paper was evaluated. The results are shown in Tables 2 and 4.

EXAMPLE 6

The procedure of Example 1 was repeated except that talc, having an average particle size of 2.0 μm, was used in place of heavy calcium carbonate to obtain a support (A) having a composition and a structure as shown in Table 1.

In the same manner as in Example 1, the thermosensitive recording layer (B) was formed on the support (A) to obtain a thermosensitive recording paper.

The resulting thermosensitive recording paper was evaluated. The results are shown in Table 2.

EXAMPLE 7

The procedure of Example 1 was repeated except that calcined clay having an average particle size of 0.8 μm was used in place of heavy calcium carbonate to obtain a support having a composition and a structure as shown in Table 1.

In the same manner as in Example 1, the thermosensitive recording layer (B) was formed on the support (A).

The resulting thermosensitive recording paper was evaluated. The results are shown in Table 2.

COMPARATIVE EXAMPLE 8

Production of Support (A) for Thermosensitive Recording (1) A resin composition, comprising 70% by weight of polypropylene having an MFR of 0.8 g/10 min, 20% by weight of high-density polyethylene and 10% by weight of heavy calcium carbonate having an average particle size of 1.5 μm, was extruded at 270° C. into a sheet using an extruder. The sheet was cooled to about 60° C. by means of cooling rollers to obtain an unstretched sheet.

The unstretched sheet was heated to 150° C. and stretched 5 times in the longitudinal direction by utilizing a difference in peripheral speed among a number of rollers. The stretched sheet was reheated to 162° C. and then stretched 7.5 times in the width direction by means of a tenter, followed by annealing at 165° C. The sheet was cooled to 60° C. and trimmed to obtain a support (A), which was composed of a biaxially stretched film (base layer (a) only) having a thickness of 80 μm.

Production of Thermosensitive Recording Paper

In the same manner as in Example 1, the thermosensitive recording layer (B) was formed on the support (A) to obtain a thermosensitive recording paper.

The resulting thermosensitive recording paper was evaluated. The results are shown in Table 4.

EXAMPLE 11

The support (A) composed of the stretched resin sheet laminate having a thickness of 80 μm and the four layer structure ($b^1/b^2/a/c$=3 μm/12 μm/50 μm/15 μm) obtained in Example 2 was laminated onto the surface and back sides of the best quality paper having a thickness of 40 μm by means of an adhesive to obtain a support (A) for thermosensitive recording, which had a density of 0.78 g/cm$^3$ and a nine layer structure ($b^1/b^2/a/c$/the best quality paper/$b^1/b^2/a/c$).

In the same manner as in Example 1, the thermosensitive recording layer (B) was provided on the $b^1$ layer side of the support (A) for thermosensitive recording to produce a thermosensitive recording paper. The resulting thermosensitive recording paper was evaluated. It was found that print with good gradation (Macbeth density: 0.22, grade 5) could be obtained, and the adhesion of coating was good (grade 5).

TABLE 1

| | Surface layer (b) | | | | | | | | |
|---|---|---|---|---|---|---|---|---|---|
| | $b^1$ | | | | $b^2$ | | | | |
| | PP | Inorganic filler | | Thick- | PP | Inorganic filler | | Thick- | Thick- |
| Example | Amount (wt %) | Type | Amount (wt %) | ness (μm) | Amount (wt %) | Type | Amount (wt %) | ness (μm) | ness (μm) |
| 1 | 85 | $CaCO_3$ | 15 | 3 | 55 | $CaCO_3$ | 45 | 12 | 15 |
| 2 | 85 | $CaCO_3$ | 15 | 3 | 45 | $CaCO_3$ | 55 | 12 | 15 |
| 3 | 85 | $CaCO_3$ | 15 | 5 | 45 | $CaCO_3$ | 55 | 10 | 18 |
| 4 | 100 | — | — | 3 | 45 | $CaCO_3$ | 55 | 12 | 15 |
| 5 | 75 | $CaCO_3$ | 25 | 3 | 45 | $CaCO_3$ | 55 | 12 | 15 |
| 6 | 75 | talc | 25 | 3 | 45 | talc | 55 | 12 | 15 |
| 7 | 85 | silica clay | 15 | 3 | 55 | silica clay | 45 | 12 | 15 |
| 8 | 85 | $CaCO_3$ | 15 | 3 | 45 | $CaCO_3$ | 55 | 12 | 15 |
| 9 | 93 | $CaCO_3$ | 7 | 3 | 45 | $CaCO_3$ | 55 | 12 | 15 |
| 10 | 85 | $CaCO_3$ | 15 | 0.5 | 45 | $CaCO_3$ | 55 | 0.5 | 1 |

| | Base layer (a) | | | | | Back layer (c) | | | |
|---|---|---|---|---|---|---|---|---|---|
| | PP | HDPE | Inorganic filler | | Thick- | PP | Inorganic filler | | Thick- |
| Example | Amount (wt %) | Amount (wt %) | Type | Amount (wt %) | ness (μm) | Amount (wt %) | Type | Amount (wt %) | ness (μm) |
| 1 | 80 | 5 | $CaCO_3$ | 15 | 50 | 55 | $CaCO_3$ | 45 | 15 |
| 2 | 70 | 5 | $CaCO_3$ | 25 | 50 | 55 | $CaCO_3$ | 45 | 15 |
| 3 | 70 | 5 | $CaCO_3$ | 25 | 47 | 55 | $CaCO_3$ | 45 | 15 |
| 4 | 70 | 5 | $CaCO_3$ | 25 | 50 | 55 | $CaCO_3$ | 45 | 15 |
| 5 | 55 | 5 | $CaCO_3$ | 40 | 50 | 85 | $CaCO_3$ | 15 | 15 |
| 6 | 70 | 5 | talc | 25 | 50 | 55 | talc | 45 | 15 |
| 7 | 80 | 5 | silica clay | 15 | 50 | 45 | silica clay | 55 | 15 |
| 8 | 70 | 5 | $CaCO_3$ | 25 | 65 | — | — | — | — |
| 9 | 70 | 5 | $CaCO_3$ | 25 | 50 | 55 | $CaCO_3$ | 45 | 15 |
| 10 | 70 | 5 | $CaCO_3$ | 25 | 78 | 55 | $CaCO_3$ | 45 | 1 |

TABLE 2

| | Physical properties of support (A) | | | | | Thermosensitive recording paper | | | | |
|---|---|---|---|---|---|---|---|---|---|---|
| | | | | | | | Printing performance | | | |
| Example | Thickness (μm) | Density (g/cm$^3$) | Opacity (%) | Compression ratio (%) | Smoothness (sec) | Adhesion of coating | Macbeth density | Gradation | Pencil writeability (surface) | Pencil writeability (back) |
| 1 | 80 | 0.72 | 91 | 27 | 1,200 | 5 | 0.21 | 4 | 15 | 17 |
| 2 | 80 | 0.65 | 94 | 31 | 1,000 | 5 | 0.23 | 5 | 15 | 17 |
| 3 | 80 | 0.70 | 92 | 28 | 1,800 | 5 | 0.22 | 5 | 14 | 17 |
| 4 | 80 | 0.70 | 89 | 26 | 7,000 | 5 | 0.20 | 4 | 12 | 17 |
| 5 | 80 | 0.74 | 86 | 25 | 700 | 4 | 0.20 | 4 | 16 | 15 |
| 6 | 80 | 0.76 | 84 | 24 | 7,000 | 4 | 0.20 | 4 | 13 | 14 |
| 7 | 80 | 0.73 | 90 | 28 | 1,100 | 4 | 0.21 | 4 | 16 | 18 |
| 8 | 80 | 0.74 | 85 | 24 | 1,050 | 5 | 0.21 | 4 | 15 | 16 |
| 9 | 80 | 0.67 | 92 | 30 | 6,500 | 5 | 0.20 | 4 | 13 | 17 |
| 10 | 80 | 0.68 | 90 | 28 | 1,500 | 5 | 0.20 | 4 | 14 | 15 |

TABLE 3

| | Surface layer (b) | | | | | | | | |
|---|---|---|---|---|---|---|---|---|---|
| | $b^1$ | | | | $b^2$ | | | | |
| | PP | Inorganic filler | | Thick- | PP | Inorganic filler | | Thick- | Thick- |
| Comp. | Amount | | Amount | ness | Amount | | Amount | ness | ness |

TABLE 3-continued

| Ex. | (wt %) | Type | (wt %) | (μm) | (wt %) | Type | (wt %) | (μm) | (μm) |
|---|---|---|---|---|---|---|---|---|---|
| 1 | 85 | $CaCO_3$ | 15 | 3 | 55 | $CaCO_3$ | 45 | 12 | 15 |
| 2 | 45 | $CaCO_3$ | 55 | 3 | 45 | $CaCO_3$ | 55 | 12 | 15 |
| 3 | 85 | $CaCO_3$ | 15 | 5 | 55 | $CaCO_3$ | 45 | 20 | 25 |
| 4 | 100 | — | — | 6 | 45 | $CaCO_3$ | 55 | 12 | 18 |
| 5 | 85 | $CaCO_3$ | 15 | 3 | 80 | $CaCO_3$ | 20 | 12 | 15 |
| 6 | 75 | $CaCO_3$ | 25 | 3 | 45 | talc | 55 | 12 | 15 |
| 7 | — | — | — | — | 45 | $CaCO_3$ | 55 | 15 | 15 |
| 8 | — | — | — | — | — | — | — | — | — |

| | Base layer (a) | | | | | Back Layer (c) | | | |
|---|---|---|---|---|---|---|---|---|---|
| | PP | HDPE | Inorganic filler | | Thick- | PP | Inorganic filler | | Thick- |
| Comp. Ex. | Amount (wt %) | Amount (wt %) | Type | Amount (wt %) | ness (μm) | Amount (wt %) | Type | Amount (wt %) | ness (μm) |
| 1 | 87 | 5 | $CaCO_3$ | 8 | 50 | 40 | $CaCO_3$ | 45 | 15 |
| 2 | 80 | 5 | $CaCO_3$ | 15 | 50 | 40 | $CaCO_3$ | 45 | 15 |
| 3 | 80 | 5 | $CaCO_3$ | 15 | 30 | 40 | $CaCO_3$ | 45 | 25 |
| 4 | 80 | 5 | $CaCO_3$ | 15 | 44 | 40 | $CaCO_3$ | 45 | 18 |
| 5 | 90 | 5 | $CaCO_3$ | 5 | 50 | 80 | $CaCO_3$ | 20 | 15 |
| 6 | 45 | 5 | $CaCO_3$ | 50 | 50 | 55 | $CaCO_3$ | 45 | 15 |
| 7 | 70 | 5 | $CaCO_3$ | 25 | 50 | 55 | $CaCO_3$ | 45 | 15 |
| 8 | 70 | 20 | $CaCO_3$ | 10 | 80 | — | — | — | — |

TABLE 4

| | Physical properties of support (A) | | | | | Thermosensitive recording paper | | | | |
|---|---|---|---|---|---|---|---|---|---|---|
| | | | | | | | Printing performance | | | |
| Comp. Ex. | Thickness (μm) | Density ($g/cm^3$) | Opacity (%) | Compression ratio (%) | Smoothness (sec) | Adhesion of coating | Macbeth density | Gradation | Pencil writeability (surface) | Pencil writeability (back) |
| 1 | 80 | 0.80 | 88 | 20 | 1,000 | 5 | 0.11 | 1 | 15 | 17 |
| 2 | 80 | 0.70 | 91 | 28 | 400 | 3 | 0.13 | 2 | 16.5 | 17 |
| 3 | 80 | 0.80 | 87 | 22 | 800 | 5 | 0.13 | 1 | 16 | 17.5 |
| 4 | 80 | 0.74 | 86 | 20 | 9,500 | 5 | 0.11 | 1 | 11 | 17 |
| 5 | 80 | 0.89 | 65 | 13 | 7,000 | 5 | 0.10 | 1 | 13 | 16 |
| 6 | 80 | 0.52 | 95 | 38 | 600 | 2 | 0.20 | 4 | 16 | 17 |
| 7 | 80 | 0.66 | 94 | 30 | 380 | 2 | 0.12 | 2 | 16.5 | 17 |
| 8 | 100 | 0.66 | 89 | 28 | 800 | 1 | 0.20 | 4 | 14 | 14 |
| Example 1 of JP-A-4-119879 | | | | | | | | | 11 | 11 |

EXAMPLE 12

Production of Support (A) for Thermal Dye Transfer Type Image Receiving Paper (1) A blend obtained by blending 15% by weight of calcium carbonate having an average particle size of 1.5 μm with 80% by weight of polypropylene having a melt flow rate (MFR) of 0.8 g/10 min and 5% by weight of high-density polyethylene was kneaded in an extruder set to 270° C. and extruded into a sheet. The sheet was cooled in a cooling device to obtain an unstretched sheet. The sheet was heated to 150° C. and stretched 5 times in the longitudinal direction to obtain a 5 times-stretched sheet for the base layer (a).

(2) A resin composition for the outer layer ($b^1$), composed of a mixture of 85% by weight of polypropylene having an MFR of 4.0 g/10 min and 15% by weight of calcium carbonate having an average particle size of 1.5 μm and a resin composition for the inner layer ($b^2$), composed of a mixture of 55% by weight of polypropylene having an MFR of 4.0 g/10 min and 45% by weight of calcium carbonate having an average particle size of 1.5 μm were separately melt-kneaded in extruders set at a temperature of 230° C. The die orifice was adjusted to obtain a film laminate wherein the final thickness of the outer layer ($b^1$) after stretching was 5 μm, and the final thickness of the inner sheet ($b^2$) was 15 μm. The melt-kneaded compositions were then co-extruded into a film laminate. The extruded film laminate for the surface layer (b) was laminated onto one side of the stretched sheet for the base layer (a). Separately, a resin composition for the back layer (c), composed of a mixture of 55% by weight of polypropylene having an MFR of 4.0 g/10 min and 45% by weight of calcium carbonate having an average particle size of 1.5 μm was melt-kneaded in an extruder. The die orifice was adjusted so that the final thickness of the back layer (c) after stretching was 20 μm, and the melt-kneaded composition was extrusion laminated onto the other side of the stretched sheet for the base layer (a).

The laminate was cooled to 60° C., reheated to 165° C. and stretched 7.5 times in the width direction by using a tenter, and annealed at 167° C. The laminate was cooled to 60° C. and trimmed to obtain a support (A) for thermal dye transfer type image receiving paper, which had a four layer structure ($b^1/b^2/a/c=5$ μm/15 μm/110 μm/20 μm) and a thickness of 150 μm.

The structure and composition of the resulting support (A) for the thermal dye transfer type image receiving sheet, composed of the stretched resin sheet laminate, are shown in Table 5. The support (A) had a density of 0.72 $g/cm^3$, an opacity of 97%, a compression ratio of 26% and a Bekk smoothness of 1,200 seconds.

Production of Coating Composition for Thermal Dye Transfer Type Image Receiving Layer A thermal dye transfer type image receiving layer having the following composition was coated on the surface layer (b) of the support (A) in such an amount as to provide a dry thickness of 4 μm to obtain a thermal dye transfer type image receiving sheet. The coating was carried out by means of wire bar coating.

| Ingredient | Amount (parts by weight) |
|---|---|
| Saturated polyester | |
| Vylon 200 having a Tg of 67° C. manufactured by Toyoboseki Co., Ltd. | 5.3 |
| Vylon 290 having a Tg of 77° C. manufactured by Toyoboseki Co., Ltd. | 5.3 |
| Vinylite VYHH (vinyl chloride/vinyl acetate copolymer manufactured by Union Carbide Corp.) | 4.5 |
| Titanium oxide (KA-10 manufactured by Titan Kogyo KK) | 1.5 |
| Amino-modified silicone oil (KF-393 manufactured by Shin-Etsu Silicone KK) | 1.1 |
| Epoxy-modified silicone oil (X-22-343 manufactured by Shin-Etsu Silicone KK) | 1.1 |

Evaluation

The resulting thermal dye transfer type image receiving sheet was evaluated. The height of curl, the deformation of the surface caused by heat and gradation were evaluated. The results are shown in Tables 5 and 6.

EXAMPLES 13 TO 19 AND COMPARATIVE EXAMPLES 9 TO 15

The procedure of Example 12 was repeated except the composition of each layer of the supports (A) and the value of the die orifice were varied as shown in Tables 5 and 7. Supports (A) having the physical properties shown in Tables 6 and 8, were obtained.

In the same manner as in Example 12, the thermal dye transfer type image receiving layer (B') was formed on the support.

The resulting thermal dye transfer type image receiving sheets were evaluated. The results are shown in Tables 6 and 8.

EXAMPLE 20

The procedure of Example 12 was repeated except that talc having an average particle size of 2.0 μm was used in place of heavy calcium carbonate to obtain a support (A) having a composition and a structure as shown in Table 5.

In the same manner as in Example 12, the thermal dye transfer type image receiving layer (B') was formed on the support (A) to obtain a thermal dye transfer type image receiving paper.

The resulting thermal dye transfer type image receiving paper was evaluated. The results are shown in Table 6.

EXAMPLE 21

The procedure of Example 12 was repeated except that calcined clay having an average particle size of 0.8 μm was used in place of heavy calcium carbonate to obtain a support (A) having a composition and a structure as shown in Table 5.

In the same manner as in Example 12, the thermal dye transfer type image receiving layer (B') was formed on the support (A) to obtain a thermal dye transfer type image receiving paper.

The resulting thermal dye transfer type image receiving paper was evaluated. The results are shown in Table 6.

COMPARATIVE EXAMPLE 16

Production of Support (A) for Thermal Dye Transfer Type Image Receiving Paper (1) A resin composition comprising 70% by weight of polypropylene having an MFR of 0.8 g/10 min, 20% by weight of high-density polyethylene and 10% by weight of heavy calcium carbonate having an average particle size of 1.5 μm was extruded at 270° C. into a sheet by using an extruder. The sheet was cooled to about 60° C. by means of cooling rollers to obtain an unstretched sheet.

The unstretched sheet was heated to 150° C. and stretched 5 times in the longitudinal direction by utilizing a difference in peripheral speed among a number of rollers. The stretched sheet was reheated to about 162° C. and then stretched 7.5 times in the width direction by means of a tenter, followed by annealing at 165° C. The sheet was cooled to 60° C. and trimmed to obtain a support (A) which had a thickness of 150 μm and was composed of a biaxially stretched film (base layer (a) only).

Production of Thermal Dye Transfer Type Image Recording Paper

In the same manner as in Example 12, the thermal dye transfer type image receiving layer (B') was formed on the support (A) to obtain a thermal dye transfer type image receiving paper.

The resulting thermal dye transfer type image receiving paper was evaluated. The results are shown in Table 8.

EXAMPLE 22

A support (A) having a thickness of 60 μm composed of a stretched resin sheet was produced in the same manner as in Example 12 except that the die orifice was adjusted to obtain a film laminate having a four layer structure ($b^1/b^2/a/c=3$ μm/12 μm/30 μm/15 μm). The support (A) was laminated onto the surface and back sides of the best quality paper having a thickness of 40 μm by means of an adhesive to obtain a support (A) which had a density of 0.78 g/cm$^3$ and a nine layer structure ($b^1/b^2/a/c$/the best quality paper/$b^1/b^2/a/c$).

In the same manner as in Example 12, the thermal dye transfer type image receiving layer (B') was provided on the $b^1$ layer side of the support (A) to obtain a thermal dye transfer type image receiving paper. The resulting thermal dye transfer type image receiving paper was evaluated. Print with good gradation (Macbeth density: 0.22, grade of evaluation: 5) was obtained, and the adhesion of coating was good (grade of evaluation: 5).

TABLE 5

| Surface layer (b) | | | | | | | |
|---|---|---|---|---|---|---|---|
| ($b^1$) | | | | ($b^2$) | | | |
| PP Amount | Inorganic filler Amount | Thickness | | PP Amount | Inorganic filler Amount | Thickness | Thickness |

TABLE 5-continued

| Example | (wt %) | Type | (wt %) | (μm) | (wt %) | Type | (wt %) | (μm) | (μm) |
|---|---|---|---|---|---|---|---|---|---|
| 12 | 85 | $CaCO_3$ | 15 | 5 | 55 | $CaCO_3$ | 45 | 15 | 20 |
| 13 | 85 | $CaCO_3$ | 15 | 5 | 45 | $CaCO_3$ | 55 | 15 | 20 |
| 14 | 85 | $CaCO_3$ | 15 | 10 | 45 | $CaCO_3$ | 55 | 25 | 35 |
| 15 | 100 | — | — | 5 | 45 | $CaCO_3$ | 55 | 15 | 20 |
| 16 | 75 | $CaCO_3$ | 25 | 5 | 45 | $CaCO_3$ | 55 | 15 | 20 |
| 17 | 85 | $CaCO_3$ | 15 | 5 | 45 | $CaCO_3$ | 55 | 15 | 20 |
| 18 | 93 | $CaCO_3$ | 7 | 5 | 45 | $CaCO_3$ | 55 | 15 | 20 |
| 19 | 85 | $CaCO_3$ | 15 | 0.5 | 45 | $CaCO_3$ | 55 | 0.5 | 1 |
| 20 | 75 | talc | 25 | 5 | 45 | talc | 55 | 15 | 20 |
| 21 | 85 | silica clay | 15 | 5 | 55 | silica clay | 45 | 15 | 20 |

| | Base layer (a) | | | | | Back Layer (c) | | | |
|---|---|---|---|---|---|---|---|---|---|
| | PP | HDPE | Inorganic filler | | Thick- | PP | Inorganic filler | | Thick- |
| Example | Amount (wt %) | Amount (wt %) | Type | Amount (wt %) | ness (μm) | Amount (wt %) | Type | Amount (wt %) | ness (μm) |
| 12 | 80 | 5 | $CaCO_3$ | 15 | 110 | 55 | $CaCO_3$ | 45 | 20 |
| 13 | 70 | 5 | $CaCO_3$ | 25 | 110 | 55 | $CaCO_3$ | 45 | 20 |
| 14 | 70 | 5 | $CaCO_3$ | 25 | 80 | 55 | $CaCO_3$ | 45 | 35 |
| 15 | 70 | 5 | $CaCO_3$ | 25 | 110 | 55 | $CaCO_3$ | 45 | 20 |
| 16 | 55 | 5 | $CaCO_3$ | 40 | 110 | 85 | $CaCO_3$ | 15 | 20 |
| 17 | 70 | 5 | $CaCO_3$ | 25 | 130 | — | — | — | — |
| 18 | 70 | 5 | $CaCO_3$ | 25 | 110 | 55 | $CaCO_3$ | 45 | 20 |
| 19 | 70 | 5 | $CaCO_3$ | 25 | 148 | 55 | $CaCO_3$ | 45 | 1 |
| 20 | 70 | 5 | talc | 25 | 110 | 55 | talc | 45 | 20 |
| 21 | 80 | 5 | silica clay | 15 | 110 | 45 | silica clay | 55 | 20 |

TABLE 6

| | Physical properties of support (A) | | | | | Thermal dye transfer type image receiving paper | | | | |
|---|---|---|---|---|---|---|---|---|---|---|
| | | | | | | | Printing performance | | Pencil | Pencil |
| Example | Thickness (μm) | Density (g/cm³) | Opacity (%) | Compression ratio (%) | Smoothness (sec) | Adhesion of coating | Macbeth density | Gradation | writeability (surface) | writeability (back) |
| 12 | 150 | 0.72 | 97 | 26 | 1,240 | 5 | 0.22 | 4 | 15 | 17 |
| 13 | 150 | 0.65 | 98 | 30 | 1,020 | 5 | 0.24 | 5 | 15 | 17 |
| 14 | 150 | 0.70 | 97 | 27 | 1,820 | 5 | 0.22 | 5 | 14 | 17 |
| 15 | 150 | 0.70 | 96 | 25 | 7,300 | 5 | 0.21 | 4 | 12 | 17.5 |
| 16 | 150 | 0.74 | 95 | 24 | 710 | 4 | 0.20 | 4 | 16 | 15 |
| 17 | 150 | 0.74 | 95 | 23 | 1,080 | 5 | 0.21 | 4 | 15 | 16 |
| 18 | 150 | 0.67 | 97 | 29 | 6,700 | 5 | 0.20 | 4 | 13 | 17 |
| 19 | 150 | 0.68 | 96 | 27 | 1,550 | 5 | 0.21 | 4 | 14 | 16 |
| 20 | 150 | 0.76 | 95 | 23 | 7,300 | 4 | 0.20 | 4 | 13 | 14 |
| 21 | 150 | 0.73 | 96 | 27 | 1,100 | 4 | 0.21 | 4 | 15 | 18 |

TABLE 7

| | Surface layer (b) | | | | | | | | |
|---|---|---|---|---|---|---|---|---|---|
| | ($b^1$) | | | | ($b^2$) | | | | |
| | PP | Inorganic filler | | Thick- | PP | Inorganic filler | | Thick- | Thick- |
| Comp. Example | Amount (wt %) | Type | Amount (wt %) | ness (μm) | Amount (wt %) | Type | Amount (wt %) | ness (μm) | ness (μm) |
| 9 | 85 | $CaCO_3$ | 15 | 5 | 55 | $CaCO_3$ | 45 | 15 | 20 |
| 10 | 45 | $CaCO_3$ | 55 | 5 | 45 | $CaCO_3$ | 55 | 15 | 20 |
| 11 | 85 | $CaCO_3$ | 15 | 10 | 55 | $CaCO_3$ | 45 | 40 | 50 |
| 12 | 100 | — | — | 5 | 45 | $CaCO_3$ | 55 | 15 | 20 |
| 13 | 85 | $CaCO_3$ | 15 | 5 | 80 | $CaCO_3$ | 20 | 15 | 20 |
| 14 | 75 | $CaCO_3$ | 25 | 5 | 45 | $CaCO_3$ | 55 | 15 | 20 |
| 15 | — | — | — | — | 45 | $CaCO_3$ | 55 | 20 | 20 |
| 16 | — | — | — | — | — | — | — | — | — |

| | Base layer (a) | | | | | Back Layer (c) | | | |
|---|---|---|---|---|---|---|---|---|---|
| | PP | HDPE | Inorganic filler | | Thick- | PP | Inorganic filler | | Thick- |
| Comp. Example | Amount (wt %) | Amount (wt %) | Type | Amount (wt %) | ness (μm) | Amount (wt %) | Type | Amount (wt %) | ness (μm) |
| 9 | 87 | 5 | $CaCO_3$ | 8 | 110 | 40 | $CaCO_3$ | 45 | 20 |
| 10 | 80 | 5 | $CaCO_3$ | 15 | 110 | 40 | $CaCO_3$ | 45 | 20 |
| 11 | 80 | 5 | $CaCO_3$ | 15 | 50 | 40 | $CaCO_3$ | 45 | 50 |
| 12 | 80 | 5 | $CaCO_3$ | 15 | 110 | 40 | $CaCO_3$ | 45 | 20 |
| 13 | 90 | 5 | $CaCO_3$ | 5 | 110 | 80 | $CaCO_3$ | 20 | 20 |
| 14 | 45 | 5 | $CaCO_3$ | 50 | 110 | 55 | $CaCO_3$ | 45 | 20 |
| 15 | 70 | 5 | $CaCO_3$ | 25 | 110 | 55 | $CaCO_3$ | 45 | 20 |

TABLE 7-continued

| | | | | | | | | | |
|---|---|---|---|---|---|---|---|---|---|
| 16 | 70 | 20 | $CaCO_3$ | 10 | 150 | — | — | — | — |

TABLE 8

| | Physical properties of support (A) | | | | | Thermal dye transfer type image receiving paper | | | | |
|---|---|---|---|---|---|---|---|---|---|---|
| | | | | | | | Printing performance | | | |
| Comp. Example | Thickness (μm) | Density (g/cm³) | Opacity (%) | Compression ratio (%) | Smoothness (sec) | Adhesion of coating | Macbeth density | Gradation | Pencil writeability (surface) | Pencil writeability (back) |
| 9 | 150 | 0.80 | 94 | 19 | 1,020 | 5 | 0.11 | 1 | 15 | 17 |
| 10 | 150 | 0.70 | 97 | 27 | 430 | 3 | 0.13 | 2 | 16.5 | 17.5 |
| 11 | 150 | 0.80 | 94 | 21 | 820 | 5 | 0.12 | 1 | 16 | 17 |
| 12 | 150 | 0.74 | 95 | 19 | 9,550 | 5 | 0.11 | 1 | 11 | 17 |
| 13 | 150 | 0.89 | 91 | 12 | 7,100 | 5 | 0.09 | 1 | 12 | 16.5 |
| 14 | 150 | 0.52 | 99 | 37 | 650 | 2 | 0.20 | 4 | 16 | 17 |
| 15 | 150 | 0.66 | 98 | 29 | 400 | 2 | 0.12 | 2 | 16.5 | 17 |
| 16 | 150 | 0.66 | 98 | 27 | 820 | 1 | 0.19 | 4 | 14 | 14 |

It will be understood from the above disclosure that the thermosensitive recording paper or thermal dye transfer type image receiving sheet of the present invention is excellent in surface smoothness. Since the support contain many microvoids therein, the recording paper or the image receiving sheet is excellent in cushioning effect, whereby the printing head and the recording paper or image receiving sheet can be brought into close contact with each other, and an image rich in gradation can be obtained.

Further, since the support of the present invention is excellent in coating adhesion, the recording layer does not easily peel off from the support, and hence useful thermosensitive recording paper or thermal dye transfer type image receiving paper can be obtained.

While the present invention has been described in detail and with reference to specific embodiments thereof, it is apparent to one skilled in the art that various changes and modifications can be made therein without departing from the spirit and the scope of the present invention.

What is claimed is:

1. A recording material comprising a thermosensitive recording layer (B) or a thermal dye transfer image receiving layer (B') laminated on a surface layer (b) of a support (A), wherein the support (A) comprises the surface layer (b) comprising a uniaxially stretched thermoplastic resin film laminated onto the surface of a base layer (a), wherein the base layer (a) comprises a biaxially stretched film of a thermoplastic resin containing 10 to 45% by weight of an inorganic fine powder, and wherein the support (A) satisfies the following conditions (1) to (3):

(1) the surface layer (b) of the support (A) comprises at least two layers: an outer layer ($b^1$) comprising a uniaxially stretched film of a thermoplastic resin containing 0 to 30% by weight of an inorganic fine powder; and an inner layer ($b^2$) comprising a uniaxially stretched film of a thermoplastic resin containing 30 to 80% by weight of an inorganic fine powder wherein the thickness of the outer layer ($b^1$) is 3 to 40% of that of the surface layer (b) and the thickness of the inner layer ($b^2$) is 97 to 60% of that of the surface layer (b);

(2) the thickness of the surface layer (b) is 0.5 to 30% of the whole thickness of the support (A); and (3) the support has a density of not higher than 0.80 g/cm³, an opacity of at least 70%, a compression ratio of 15 to 35% under a stress of 32 kg/cm² and a Bekk smoothness of 500 to 8,000 seconds.

2. A recording material as in claim 1, wherein the support (A) further comprises a back layer (c) comprising a uniaxially stretched film of a thermoplastic resin containing 0 to 80% by weight of an inorganic fine powder on the back side thereof, and said back layer (c) has a thickness of 0.5 to 30% of the whole thickness of the support (A).

3. A recording material as in claim 1, wherein said recording material is a thermosensitive recording paper and the coating weight of said thermosensitive recording layer (B) provided on the support is 2 to 12 g/m² on a dry basis.

4. A recording material as in claim 1, wherein said recording material is a thermosensitive recording paper or a thermal dye transfer image receiving sheet and said support (A) has a thickness of 60 to 200 μm.

5. A recording material as in claim 1, wherein said support (A) has a thickness of 60 to 200 μm, the thickness of the surface layer (b) is 0.5 to 30% of the whole thickness of the support (A), the thickness of the outer layer ($b^1$) is 3 to 40% of that of the surface layer (b) and the thickness of the inner layer ($b^2$) is 97 to 60% of that of the surface layer (b).

* * * * *